US008474081B2

(12) United States Patent
Stoltz

(10) Patent No.: US 8,474,081 B2
(45) Date of Patent: Jul. 2, 2013

(54) VORTEX TURBINE CLEANER

(76) Inventor: Herman Stoltz, Port Elizabeth (ZA)

( * ) Notice: Subject to any disclaimer, the term of this patent is extended or adjusted under 35 U.S.C. 154(b) by 191 days.

(21) Appl. No.: 13/046,714

(22) Filed: Mar. 12, 2011

(65) Prior Publication Data

US 2012/0060307 A1 Mar. 15, 2012

Related U.S. Application Data

(63) Continuation-in-part of application No. PCT/IB2008/053718, filed on Sep. 15, 2008.

(51) Int. Cl.
*E04H 4/16* (2006.01)

(52) U.S. Cl.
USPC ..... 15/1.7

(58) Field of Classification Search
USPC ..... 15/1.7
See application file for complete search history.

(56) References Cited

U.S. PATENT DOCUMENTS

| | | | | |
|---|---|---|---|---|
| 4,168,557 | A | 9/1979 | Rasch et al. | |
| 5,099,535 | A | 3/1992 | Chauvier et al. | |
| 5,412,826 | A | 5/1995 | Raubenheimer | |
| 5,507,058 | A | 4/1996 | Minami et al. | |
| 6,094,764 | A | 8/2000 | Veloskey et al. | |
| 6,854,148 | B1 * | 2/2005 | Rief et al. | 15/1.7 |
| 7,827,643 | B2 * | 11/2010 | Erlich et al. | 15/1.7 |

FOREIGN PATENT DOCUMENTS

EP 1785552 A2 * 5/2007

* cited by examiner

*Primary Examiner* — Shay Karls
(74) *Attorney, Agent, or Firm* — Eric A. Hanscom; Todd J. Langford

(57) ABSTRACT

A suction type turbine-driven pool-cleaners utilizing vortex turbines to propel and steer the pool cleaner is disclosed. The cleaner includes a housing for one or more vortex-turbine mechanisms, each with a chamber and a turbine, tracks for movement over submerged surfaces, a differential mechanism for steering purposes, a reverse of inlet flow mechanism, a cam design for engagement of steering and reversing mechanisms, a means of controller inlet flow for steering purposes, and a means of controlling flow for reversing direction of cleaner movement.

17 Claims, 12 Drawing Sheets

A ( 1 : 1 )

75
76
78
66
63
60
64
4
1
65
A

A (1:1)
A (1:2)

A
1
2
4
60
63
64
65
66
75
76
77

VORTEX TURBINE CLEANER

CROSS REFERENCE TO RELATED APPLICATIONS

This application is a continuation-in-part of PCT/IB2008/053718 filed Sep. 15, 2008, the entirety of which is hereby incorporated by reference.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of pool cleaners, and more specifically toward a suction type turbine-driven pool-cleaners utilizing vortex turbines to propel and steer the pool cleaner.

Suction type turbine-driven pool-cleaners exists in various guises, some utilize footpads to propel them forward while others use wheels and/or tracks. Each of these cleaners have various benefits, however, they have in common a turbine that has to, at least to some extent, have at any specific interval one or more blades, or part thereof between the inlet and outlet flow channel. In other words, the turbine is in the direct path of the flow of water.

This creates potential blockage problems as debris travels via the path of obstruction created by placement of the turbine between the in and outlet. Furthermore the flow of water is restricted by the turbine blades. Designers have tried to overcome this problem to some extent by using fewer blades on the turbine.

A Common phenomenon with turbines is that the blade creates drag as it rotates in the water column. Curvature of the blades will only improve this aspect to a certain extent. It speaks for itself that all other factors being equal the less the drag on the turbine blades the more power can be extracted from the turbine unit. Typically a happy medium exists between the width and shape of the blades. Usually the turbine blades will be as wide as or wider than the orifice in the inlet flow channel.

The aim of this invention is to create an efficient turbine that creates very little drag and an unobstructed open path for debris passing through the inlet and outlet flow channel.

SUMMARY OF THE INVENTION

For this invention a vortex chamber of specific design allows a vortex to be formed by the flow of water from in to outlet. By positioning a comparatively small and narrow turbine in the already formed vortex, distanced well away from the direct path between inlet and outlet channels, an increase in comparative power is generated compared to the usual placement of the turbine or part thereof in-between the inlet and outlet flow channel where the flow exerts direct pressure on the turbine blades for rotation.

Blade drag is minimized as the water column rotates irrespective of whether a turbine is positioned in the rotating water column or not. The major benefit of the positioning of the turbine away from the direct path between inlet and outlet is the creation of an open channel insofar as water-flow or debris consumption is concerned.

This feature also creates the opportunity for inlet and outlet paths to be located in very close proximity to each other as no allowance has to be made for the placement of a turbine in-between the channels. Due to the efficiency of the vortex design, the turbine blades do not have to be cupped or curved like existing designs to achieve sufficient power for the intended purpose of the drive unit. Another benefit is that the rotating water column allows large debris to be rotated in a similar fashion within the chamber thereby positioning it to conform to the outlet channel. The design incorporates a very simple reversing mechanism by merely diverting the intake of flow to rotate the vortex in the opposite direction. Due to the blades not being cupped or curved to minimize drag, no power loss occurs. The benefit of this is that the drive gears remain in their respective engaged position.

In other cleaners complex gear-shift change and clutch mechanisms are used to reverse direction of the cleaner, typically these are prone to high wear and tear. Compared to other complex steering mechanisms another feature of this invention is the use of a simple differential unit positioned in the drive shaft between the left and right drive wheels or tracks for steering purposes. Application of a braking force to one set of wheels or tracks on either side of the differential will steer the cleaner in any direction pre-determined by a cam design. The steering design may also be programmed to turn the cleaner around when the cleaner reverses direction.

Due to the efficiency of the design, sufficient power is generated to include an optional fan unit similar to that disclosed in U.S. Pat. No. 4,168,557 to assist with down-force in slippery conditions such as tiled pool surfaces.

In a preferred embodiment, instead of using a differential, twin turbines may be inserted in the vortex chamber each providing drive to a different set of wheels or tracks. By merely applying braking force to one of the turbine output shafts, a similar steering effect is achieved. It can be seen, therefore, that the placement of turbines in the already formed vortex has the main advantage of creating an open channel for flow and debris while at the same time providing sufficient power to operate, even high resistance track drive units and accessory items at normal flow rates. This same design can also be modified for use in pressure type cleaners.

The flow can be equally diverted between the two chambers to provide input to each side of the drive train individually. This enables each side of the drive train to be slowed down, stopped, or reversed together or individually. In between the dual chambers, an inlet outlet plenum zone will distribute flow to the dual chambers while allowing debris to continue unhindered from the inlet to the outlet.

By controlling the flow into the chambers, the vortex and thus turbines can be interrupted in one or both chambers to slow, stop, or reverse the turbine within that chamber. Depending upon which chamber or chambers have been stopped, reversed, or slowed down, the cleaner can go forward, backwards, steer left, or steer right. Although this design lends itself to steer by applying a braking force to one turbine's drive train or the other without a differential, flow interruption is the preferred embodiment due to its simplicity of the implementation.

The actuating mechanism for steering and reversing the cleaner can be programmed to intermittently steer or reverse the cleaner. This can be achieved by a cam design, a timed electrical, or by other means known in the art. Additionally, a flotation device integrated into the steering flap enables the clean to steer in a predetermined direction when the cleaner transitions from a horizontal to a vertical position.

The design of the current invention lends itself to be significantly wider than current cleaners of this type, thereby enabling the current invention to clean a wider area at one time. The wheel base is kept short such that the clean can transition easily between horizontal and vertical positions. Further, the intake zone area underneath the clean can be shaped such that the cleaner will not get stuck on the bottom drain of the pool.

Accordingly, the current invention is a cleaner comprising a housing for one or more vortex-turbine mechanisms, tracks for movement over submerged surfaces, a differential mechanism for steering purposes, a reverse of inlet flow mechanism, a cam design for engagement of steering and reversing mechanisms, a means of controller inlet flow for steering purposes, and a means of controlling flow for reversing direction of cleaner movement.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 2:
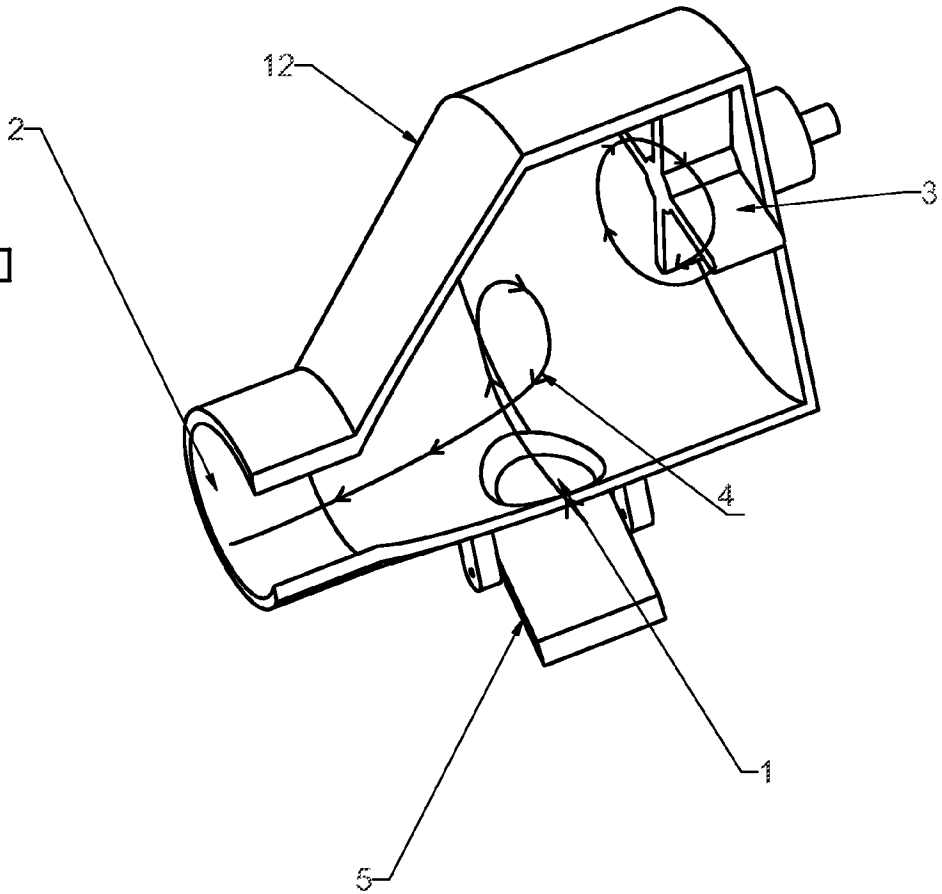
FIG. 2 illustrates a perspective cutaway drawing of the turbine within the vortex chamber.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

Figure 1:
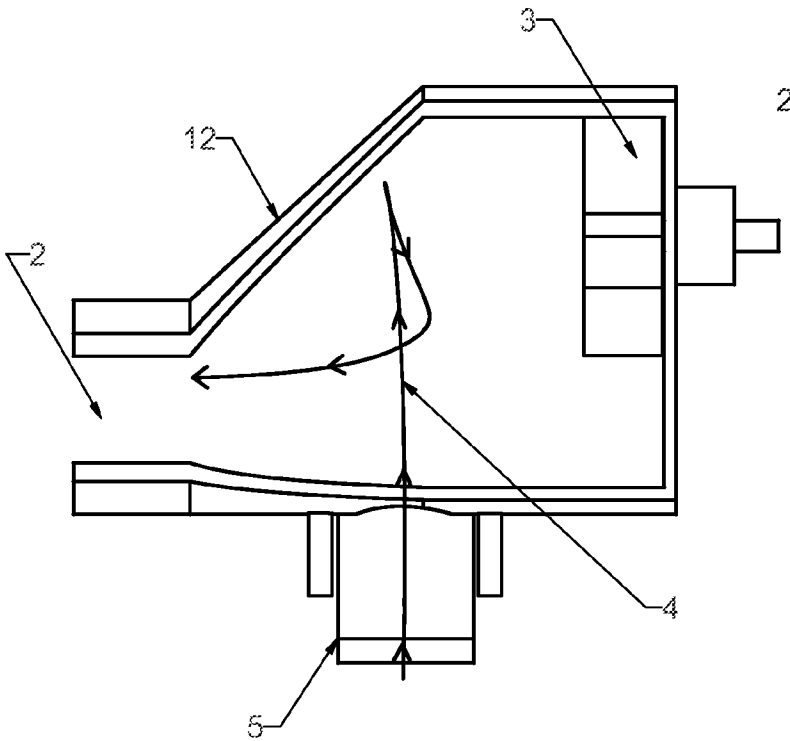
FIG. 1 illustrates a side cutaway drawing of the turbine within the vortex chamber.

As can be seen in FIGS. 1 and 2, the inlet 1 and outlet 2 are in very close proximity to each other, with turbine 3 well away from the debris path flow, represented by line 4. The debris and flow path is shown with flow direction line and arrows.

In this configuration the angle of flow is controlled by a variable flap 5 to allow for reverse rotation of the turbine system, but it can also be fixed should other means of reverse engagement be utilized.

When suction is applied to the outlet 2, flow will enter from the inlet 1 in the direction of the arrows, and a vortex will form in the vortex chamber 12 allowing the turbine 3 to rotate in the same direction as the vortex; flow as well as debris will continue unhindered through the outlet 2 as shown by the line 4. Due to the turbine 3 being positioned well away from the direct flow path between 1 and 2, debris and flow will not be influenced by the turbine as in other turbine cleaners. This makes the design very effective insofar as debris consumption is concerned.

Figure 3:
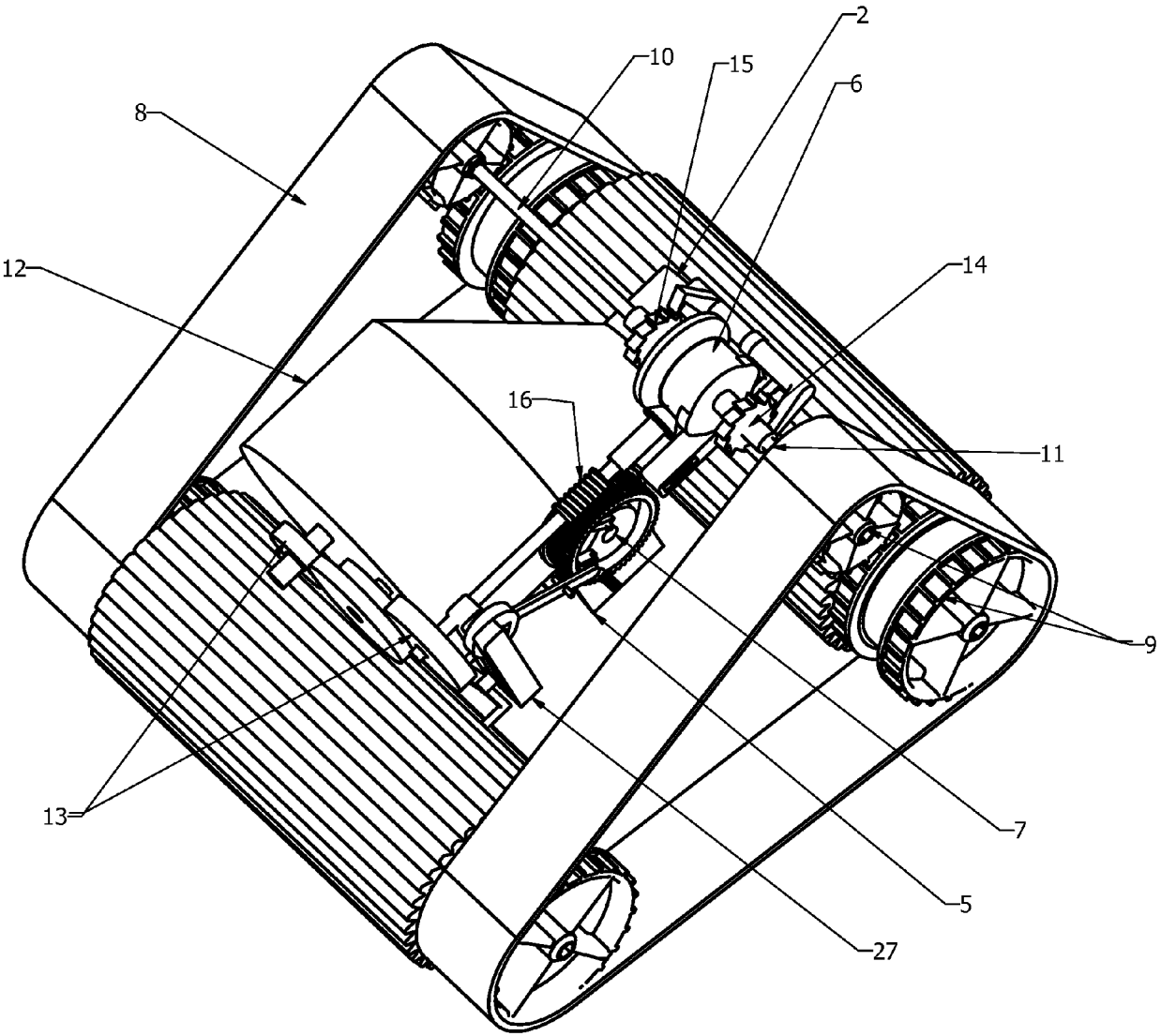
FIG. 3 illustrates a top view of the cleaner with outer body removed to show the relationship between the various parts.

FIG. 3 illustrates the cleaner as a whole with outer housing removed to show in particular the differential unit 6 and cam 7 reverse and steering mechanisms as well as their relation to the rest of the cleaner, including tracks 8, drive wheels 9, drive axles 10 and 11, vortex chamber 12, intake at flap 5, and outlet 2.

Once drive is being transferred from the turbine to the gearing system 13 and differential unit 6, the cleaner will move forwards or backwards depending on the position of the variable steering flap 5. The differential unit 6 is placed in-between the two output drive axles 10 and 11 that in turn transfer drive to the tracks 8 via drive wheels 9.

The purpose of the differential is to function as a simple steering mechanism that will steer the cleaner towards a braked side, by merely braking either side of differential output drive axles 10 or 11, via ratchet 14 and 15, the unbraked output axle will in turn accelerate due to the gear ratio of the differential. This acceleration on one side assists in overcoming drag created on the braked side especially when using tracks. Under normal operating conditions on the pool floor, a cam 7 system will control the ratchet mechanism 14 and 15 to steer the cleaner in a pre-programmed manner. The cam 7 in this case receives input via a worm gear 16, which is attached to the drive mechanism.

Figure 4:
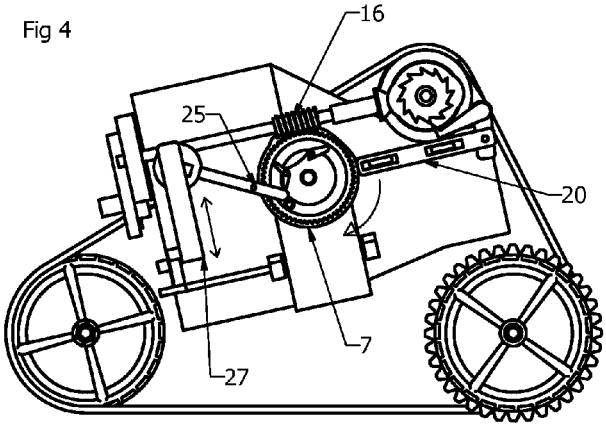
FIG. 4 illustrates the steering mechanism and the cam position in a first steering position.
Figure 5:
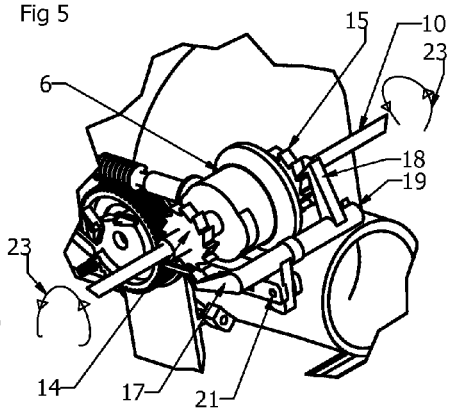
FIG. 5 illustrates a close up view of the steering mechanism and the cam position of FIG. 4.
Figure 6:
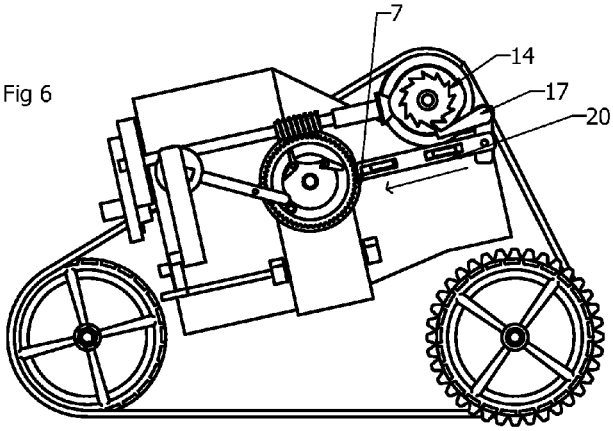
FIG. 6 illustrates the steering mechanism and the cam position in a second steering position.
Figure 7:
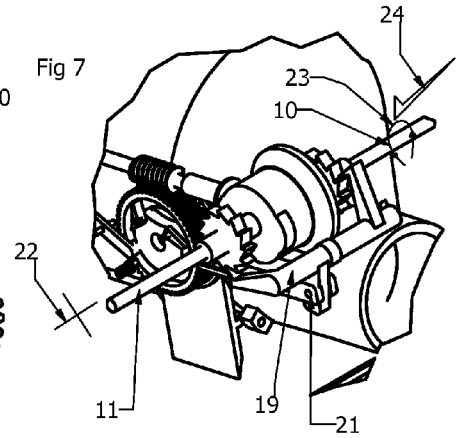
FIG. 7 illustrates a close up view of the steering mechanism and the cam position of FIG. 6.
Figure 8:
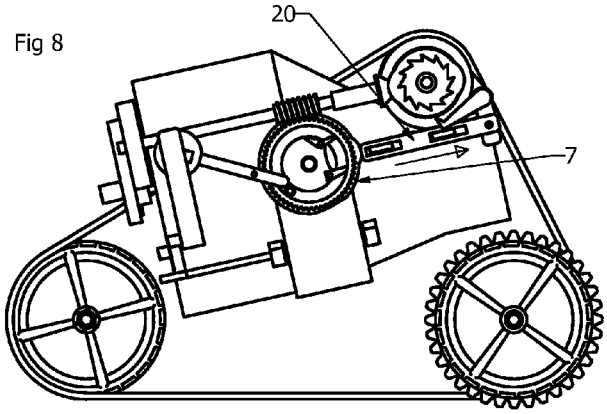
FIG. 8 illustrates the steering mechanism and the cam position in a third steering position
Figure 9:
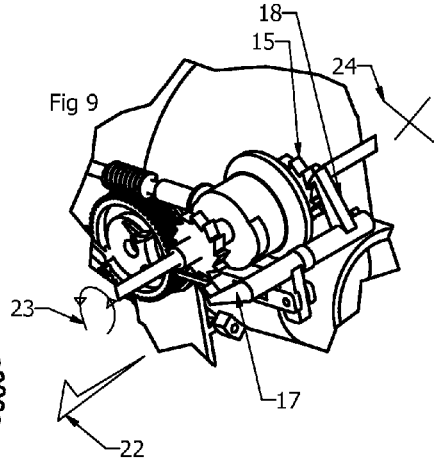
FIG. 9 illustrates a close up view of the steering mechanism and the cam position of FIG. 8.

Different cam profiles will create different steering patterns to accommodate various factors inherent in a specific pool design. In the preferred design, the cam can easily be replaced by clipping different cam profiles onto the cam shaft. In FIGS. 4 and 5, with suction applied and turbine rotating, cam 7 is in a position where both engagement arms 17 and 18 on shaft 19 are disengaged from the two ratchets 14 and 15. The cleaner will progress in a normal forward motion in a straight line. As cam 7 continues clockwise rotation, it will rotate to a position as depicted in FIGS. 6 and 7, where the spring or flotation biased sliding link 20 will keep the link in contact with recessed surface on cam 7, steering link 20 is connected to shaft 19 via pin 21. In turn arm 17 will now engage ratchet 14. As soon as arm 17 engages ratchet 14, drive axle 11 will stop its rotation at side 22. However, opposing drive axle 10 will accelerate in the direction of arrows 23, therefore side 24 will be the accelerating side. As can be seen in FIGS. 8 and 9, continuation of the cam rotation will bring the extended lobe on cam 7 in contact with sliding link 20 thereby leading to engagement of arm 18 to ratchet 15. Side 22 now depicts the side accelerating in direction of arrows 23 and side 24 depicts the braked side receiving no input. Thus it can be seen how the cleaner can be steered left and right by applying a braking force to either side of the differential shafts. The cleaner will steer towards the braked side. The cam profile on 7 can be optimized for various steering patterns.

Reverse mechanism: Not shown in the drawings is the outer frame structure of the cleaner, but it is important to note the following parts will rely on anchoring points on the frame to be able to exert forces on their respective mechanisms: pin 25 on arm 26, boom 27 that will fit into slots in the frame to allow for sliding of the assembly in direction of arrows 28, spring biased directional pin 29, and shaft 19.

Figure 11:
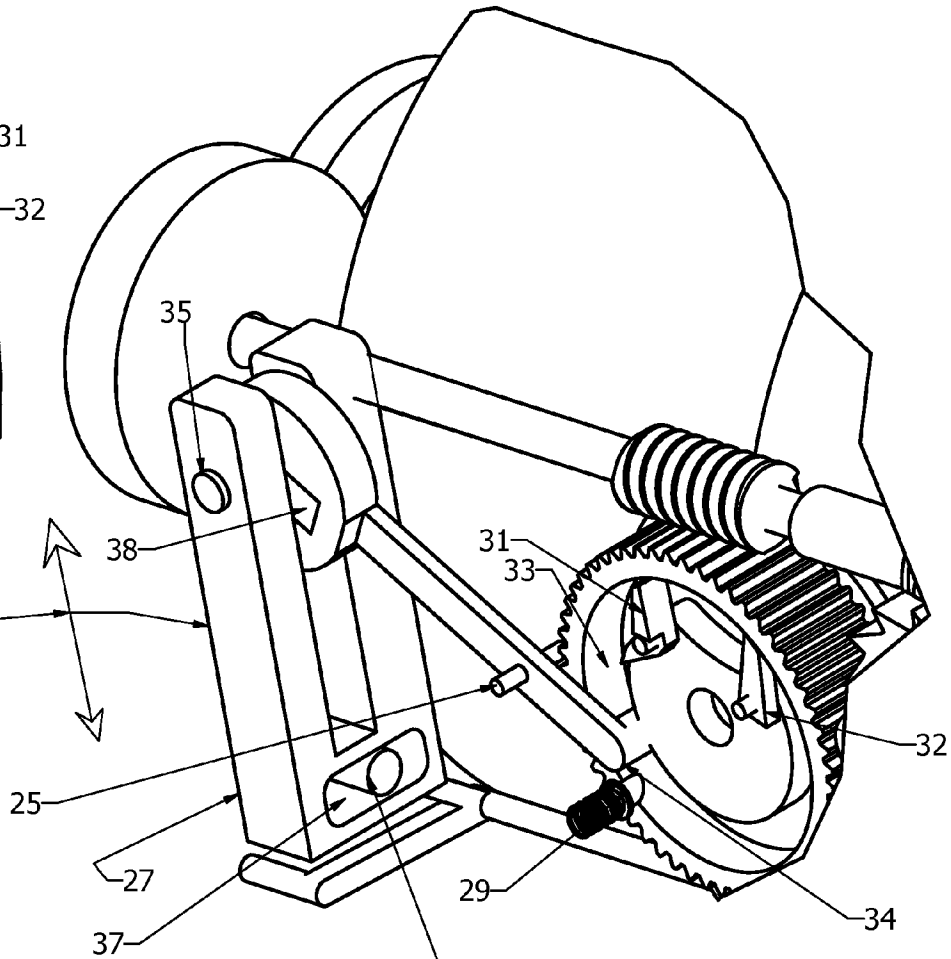
FIG. 11 illustrates a perspective view of FIG. 10.
Figure 10:
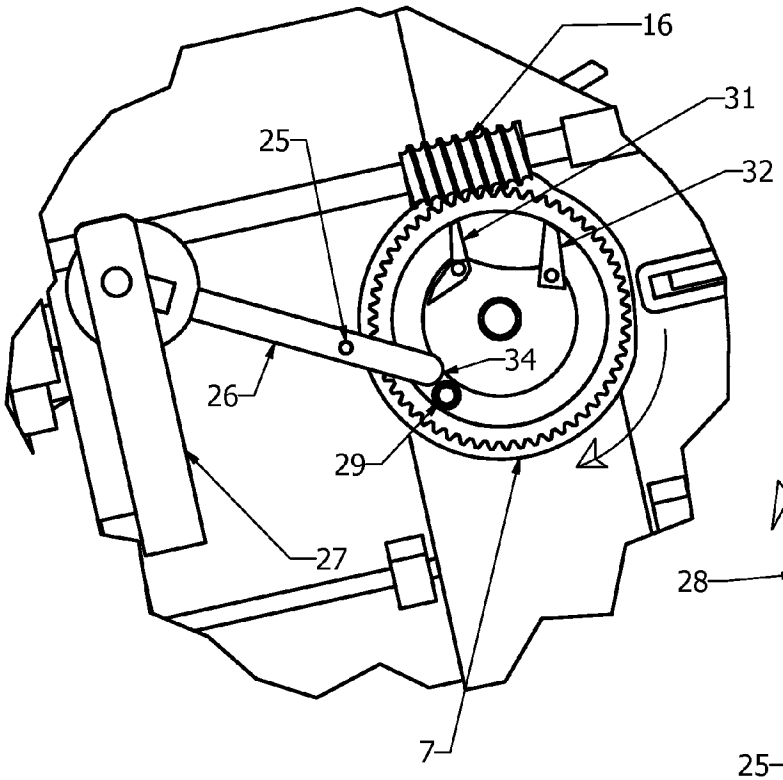
FIG. 10 illustrates a side view of the cam design for steering purposes as well as the directional flippers incorporated within the cam for reversing mechanism.

In FIGS. 10 and 11, flippers 31 and 32 rotate with cam 7 to control the position of reverse flap activation arm 26, which in turn will provide input to a set of links to enable flap 5 (shown in FIGS. 12 through 17) to switch between two positions. Cam 7 is recessed on the inside to accommodate the two flippers; the design is such that both flippers can only rotate on their respective axis to a position where they make contact with the inner cam wall 33 of cam 7. Flipper 32 is spring biased to rest against the inner cam wall 33 in the position as shown in FIGS. 10 and 11. Normal forward rotational movement of cam 7 is clockwise. Worm gear 16 provides input to cam 7. Flipper 31 is not spring biased to one specific position, but will make use of a simple toggle mechanism to flip between positions as will be described below. It may also function by using friction to keep it in a set position determined by the mechanism. Note that one side of the flipper 31 has a raised lip, the function of which will be described below. Application of force on reverse arm 26 by flippers 31 and 32 will exert pressure on the arm 26 on point 34. Arm 26 will now rotate on pin 25 to in turn force boom 27 to slide up or down dependant on cam rotational direction (see arrows 28). Arm 26 is linked to boom 27 through pin 35. Flap 5 (shown in FIGS. 12 through 17) is in turn linked to boom 27 by pin 36 through slot 37. Cut-out slots 37 and 38 are necessary to allow movement of the various linkages.

Figure 12:
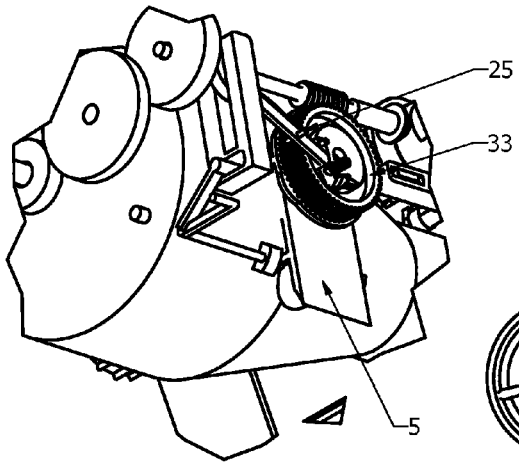
FIG. 12 is a perspective view of the engagement of the reverse mechanism and the mechanisms incorporated therein in a first position.
Figure 13:
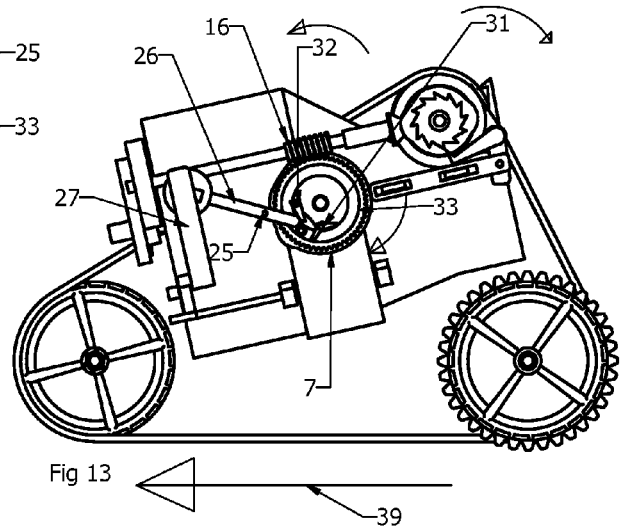
FIG. 13 is a side view of FIG. 12.
Figure 14:
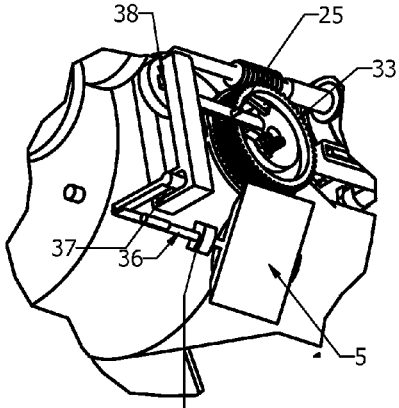
FIG. 14 is a perspective view of the engagement of the reverse mechanism and the mechanisms incorporated therein in a second position.
Figure 15:
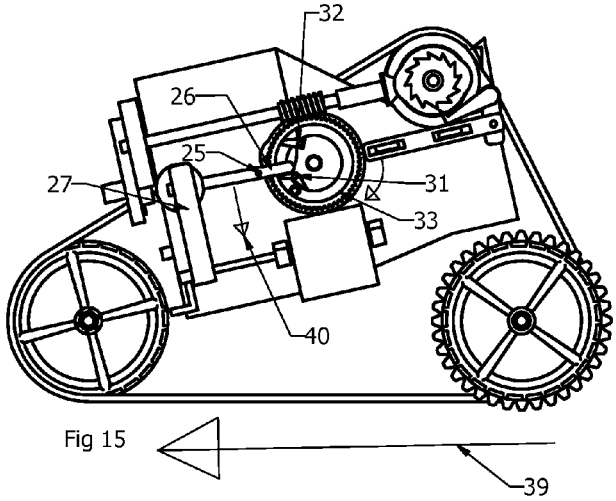
FIG. 15 is a side view of FIG. 14.

Now with reference to FIGS. 12 through 17, the cleaner will normally move in a forward direction as shown by arrows 39. A cam 7 rotates clockwise to allow flipper 32 to make contact with reverse arm 26. However flipper 32 will rotate out of the way as depicted in FIGS. 12 and 13 to allow continuous rotation of cam 7 in clockwise direction until flipper 31 comes into contact with arm 26, as shown in FIGS. 14 and 15.

Note that flipper 32, being spring biased, will return to its position resting against the inner cam wall as soon as it rotates past contact point on arm 26. Flipper 31 in this position is prevented by the inner cam wall 33 of the cam 7 from rotating away from arm 26, and therefore will exert directional force on arm 26, rotating it around pin 25 to exert downward force on boom 27 in direction of arrow 40, this in turn will provide input to pin 36 that pivots in anchor point 41.

Figure 16:
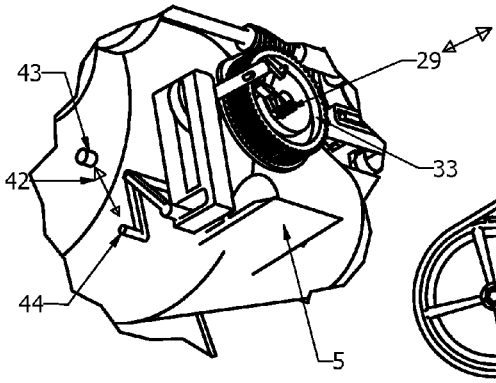
FIG. 16 is a perspective view of the engagement of the reverse mechanism and the mechanisms incorporated therein in a third position.
Figure 17:
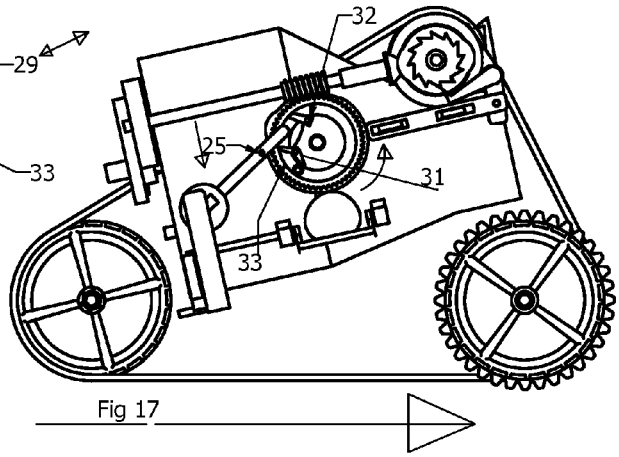
FIG. 17 is a side view of FIG. 16.

Once position of flap 5 as depicted in FIGS. 14 and 15 is reached, a toggle device will instantly switch flap 5 over to the position as depicted in FIGS. 16 and 17. The toggle device in this case will be a tensioned spring 42 anchored between points 43 and 44. The timing has to be such that the turbine will rotate in the determined direction until flap toggles to the new position, whereupon turbine will start reverse rotation.

Once in a position as depicted by FIGS. 16 and 17, the cleaner will reverse in direction of arrow 39. Simultaneously, rotation of cam 7 will reverse to anti-clockwise rotation.

Figure 18:
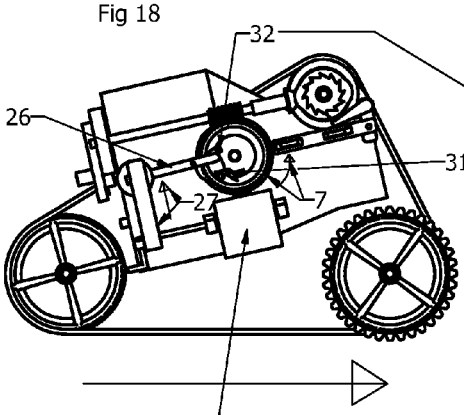
FIG. 18 is a side view showing the forward direction engagement and the inner cam mechanisms incorporated therein in a first position.
Figure 19:
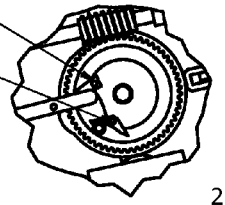
FIG. 19 is a close-up side view of the cam mechanism shown in FIG. 18.
Figure 20:
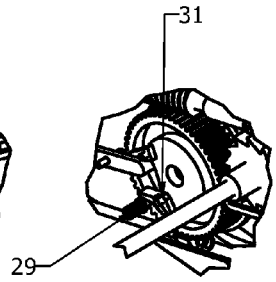
FIG. 20 is a close-up perspective view of the cam mechanism shown in FIG. 18.
Figure 21:
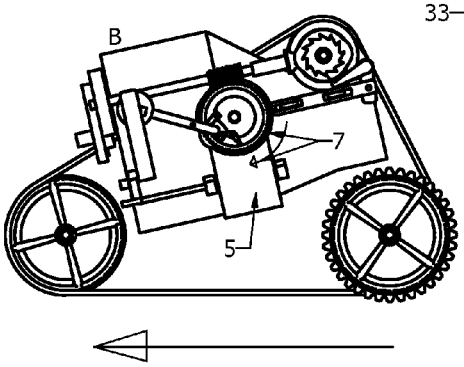
FIG. 21 is a side view showing the forward direction engagement and the inner cam mechanisms incorporated therein in a second position.
Figure 22:
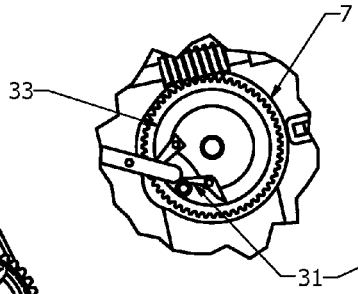
FIG. 22 is a close-up side view of the cam mechanism shown in FIG. 21.
Figure 23:
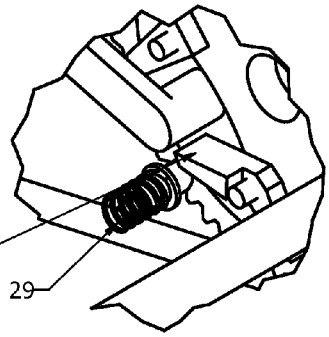
FIG. 23 is a close-up perspective view of the cam mechanism shown in FIG. 21.
Figure 24:
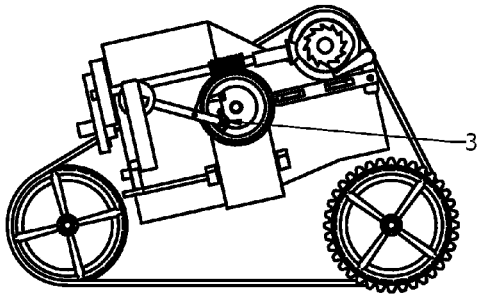
FIG. 24 is a side view showing the forward direction engagement and the inner cam mechanisms incorporated therein in a first position.
Figure 25:
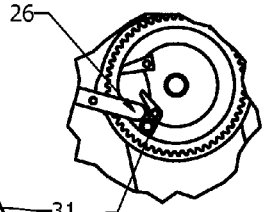
FIG. 25 is a close-up side view of the cam mechanism shown in FIG. 24.
Figure 26:
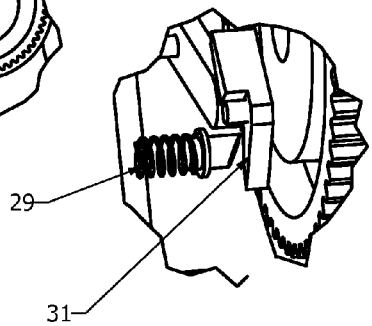
FIG. 26 is a close-up perspective view of the cam mechanism shown in FIG. 24.

As can be seen in FIGS. 18, 19, and 20, flipper 32 will now rotate anti-clockwise with cam 7. Flipper 32 is prevented from rotating away from arm 26 by inner cam wall 33 of cam 7, which exerts force on arm 26 to move it from the position shown in FIGS. 16 and 17 to the position shown in FIGS. 18, 19, and 20. The linkages connected to arm 26 will in turn provide input to flap 5 to switch it back to its original position depicted in FIGS. 12 and 13. Cam 7 will simultaneously resume turning in a clockwise direction.

However, while anti-clockwise rotation takes place, a mechanism has to move flipper 31 out of the way to allow another full three-hundred-sixty degree clockwise rotation of cam 7 before reverse rotation takes place again. This is important as the reverse mechanism must activate for a brief period only, compared to normal forward (clockwise) movement. Note that during the clockwise rotational cycle, a chamfered edge on spring biased pin 29 will allow the raised edge on flipper 31 to pass underneath while flipper is in position against the cam side walls, however the chamfered edge being directional will exert force on the raised lip on flipper 31 during the anti-clockwise cycle to rotate the flipper out of the way, as shown in FIGS. 18 through 26. Once cam 7 resumes clockwise rotation, flipper 31 is not positioned to exert any force on arm 26 (see FIGS. 24, 25, and 26), as it will merely be rotated back towards inner cam side wall upon contact with arm 26. This places it in position to exert a force on arm 26 only after the next full clockwise rotation. This procedure will allow one brief period of anti clockwise rotation for every three-hundred-sixty degree clockwise rotation of the cam. In turn the input provided by the cam will reverse turbine rotation and therefore cleaner direction for this brief period. The abovementioned procedures will allow the cleaner to intermittently steer towards a braked side determined by cam design as well as incorporating a reverse mechanism that will, for a brief period, reverse direction of the cleaner.

Figure 28:
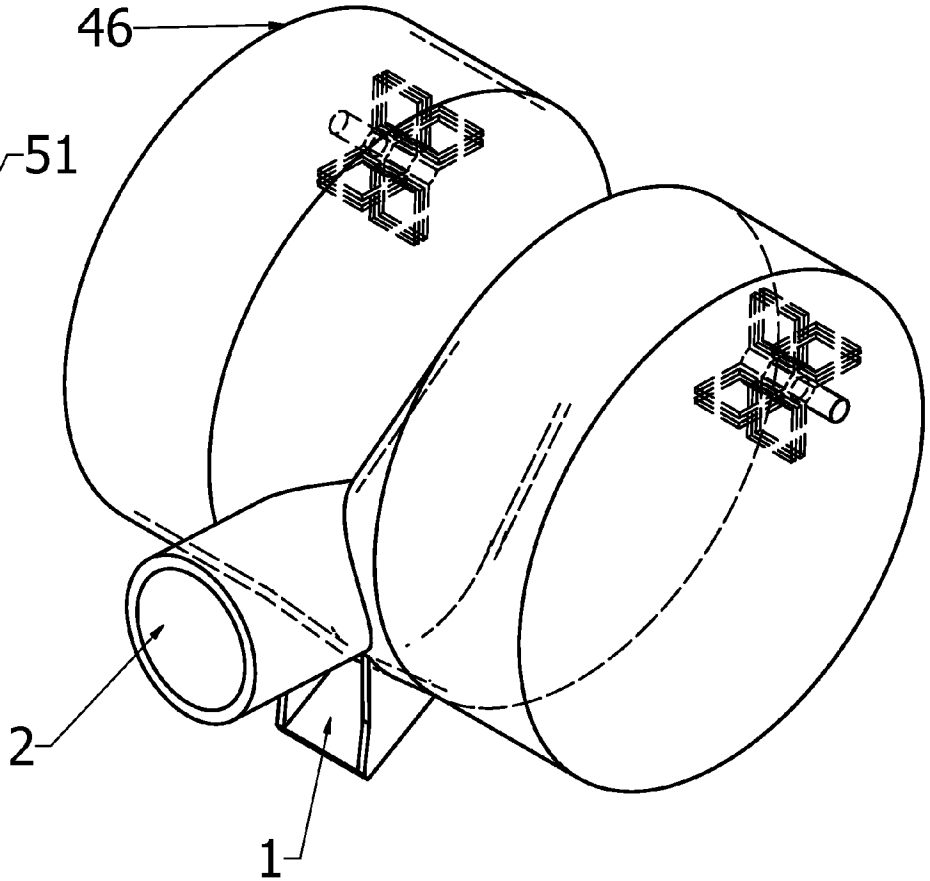
FIG. 28 is a perspective view of the dual vortex twin turbine unit shown in FIG. 27.
Figure 27:
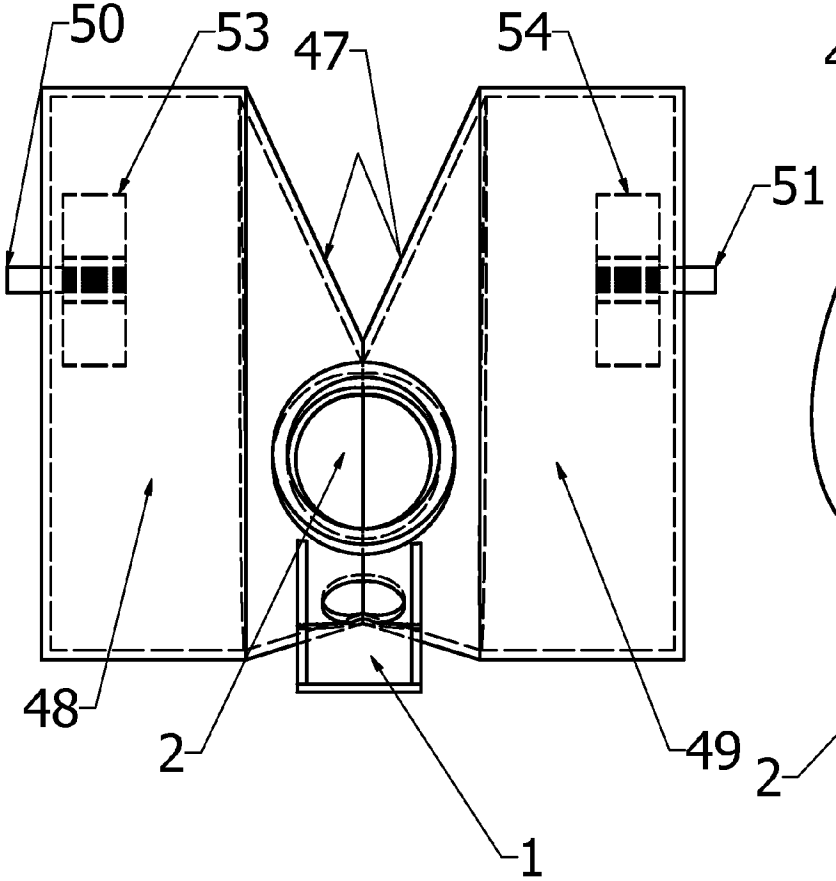
FIG. 27 is a front view of a dual vortex twin turbine unit.

A further embodiment of the vortex chamber is shown in FIGS. 27 and 28. The main purpose of this configuration is to benefit from a simple steering device without differential. Two turbines 53 and 54 are positioned in the vortex chambers 48 and 49 well away from the direct path between inlet 1 and outlet 2. Dual vortex chambers 48 and 49 are profiled 47 to divert flow equally to both chambers 48 and 49, in turn the vortex created in each chamber will rotate both turbines 53 and 54 in the same direction as the formed vortex. With the dual vortex configuration, the cleaner will be steered by applying a braking force to either one of the shafts 50 and 51 on turbines 54 and 55. In this case each turbine shaft will provide output to a set of tracks via a reduction gear system.

The steering device incorporating the rotating cam and ratchet device will be similar as described with the differential. However, in this case, instead of applying a brake force to one of the differential shafts, the brake force will be applied to either one of the turbine shafts 50 or 51. In this manner, the cleaner will steer towards the braked side. A variable flap can also be used in this configuration to reverse vortex and subsequently cleaner direction.

Even though this configuration shows the two turbines at opposite sides of the in and outlet the configuration can also be such as to allow both turbines to be placed adjacent each other on one side of the vortex chamber, in this case the chamber will be similar to the one described for the single turbine.

Figure 30:
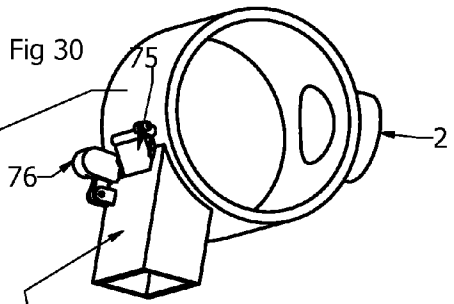
FIG. 30 is a close-up perspective view of the inlet-outlet area of the cleaner shown in FIG. 29.
Figure 29:
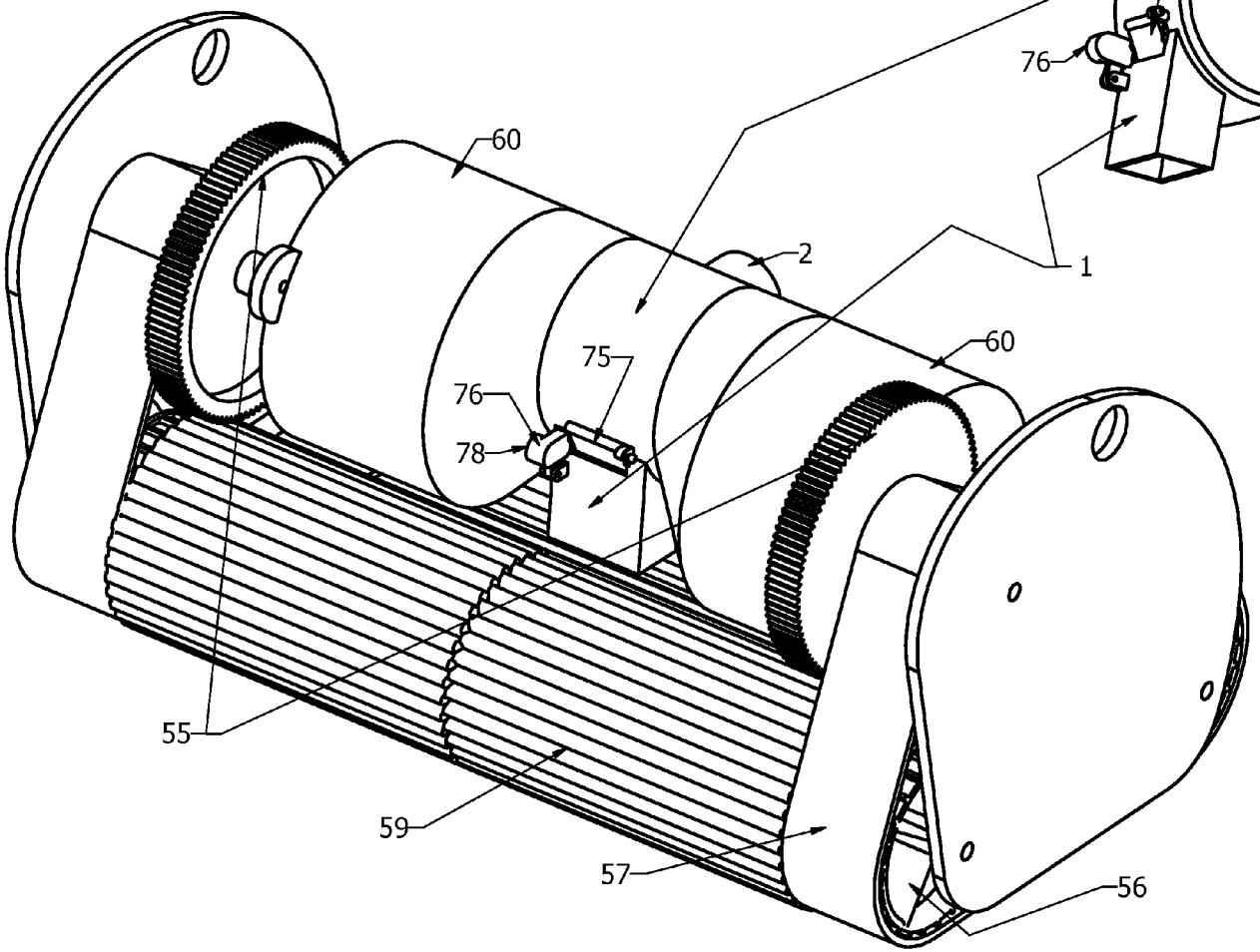
FIG. 29 illustrates a top perspective view of the cleaner in a dual chamber, twin turbine configuration with the outer body removed to show the relation ship between the various parts.

FIGS. 29 and 30 illustrates a top perspective view of the cleaner in a dual chamber, twin turbine configuration with the outer body removed to show the relation ship between the various parts. The drive train mechanisms 55, preferably gears, drive tracks 57 that travel around drive wheels 56. Rollers 59 are directly connected to the drive wheels 56 and/or drive train mechanisms 55. Reverse flap 75 and steering flap 76 allow and restrict the flow of fluid into the area between inlet 1 and outlet 2 and affect the vortexes in vortex chambers 60. Water then flows through outlet 2.

Figures 31, 32, 33:
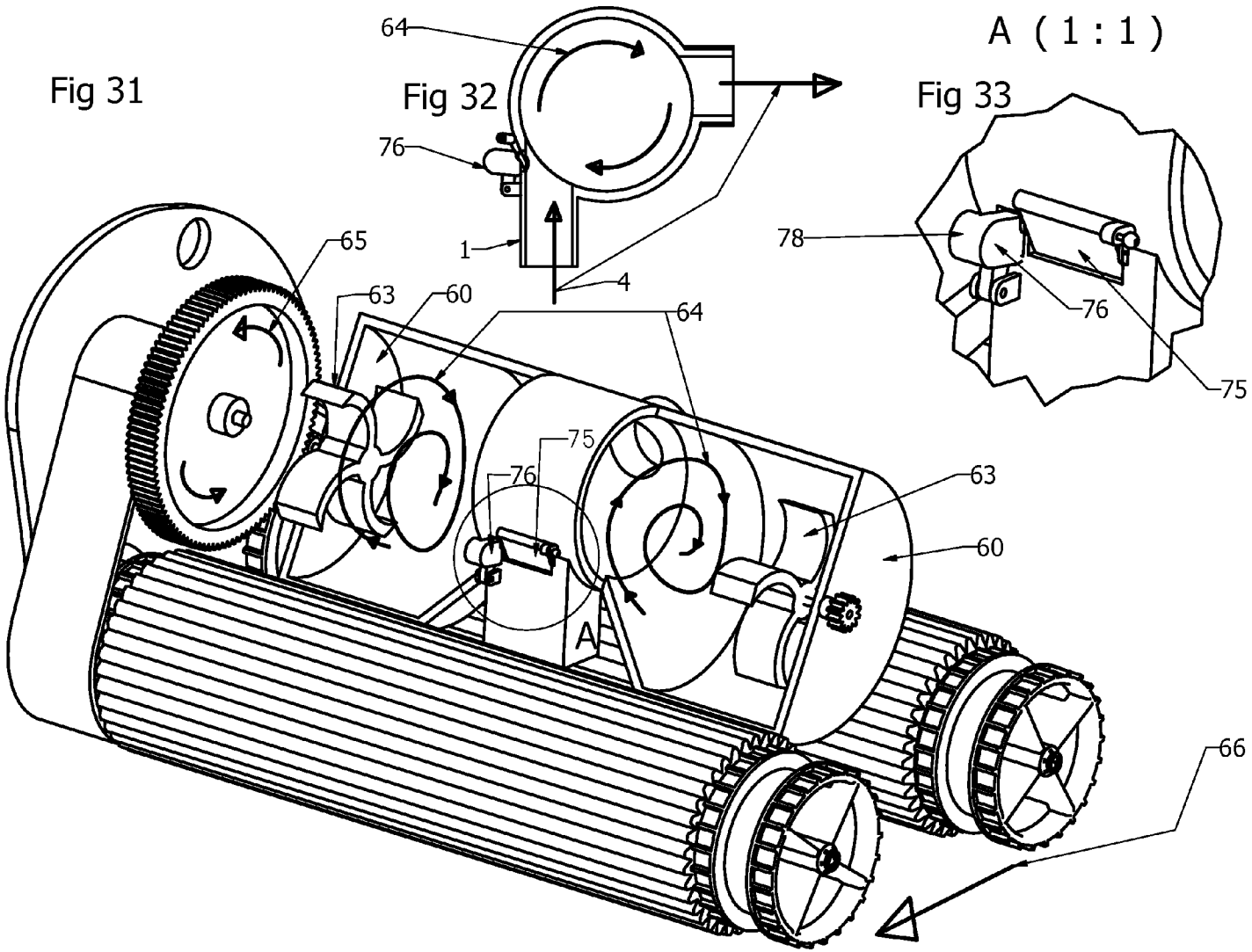
FIG. 31 illustrates a top perspective cutaway view of the cleaner of FIG. 29, with steering and reverse flaps in a closed position.
FIG. 32 is a side view of the inlet-outlet area shown in FIG. 31.
FIG. 33 is a close-up perspective view of the reverse flap area in FIG. 31.

With reference to FIGS. 31, 32, and 33, the reverse flap 75 and steering flap 76 are in a closed position. Flow arrows 64 show the direction of the water flow and vortex, as well as rotation of the turbines, in the chamber 60. Main drive gear rotates in direction 65, with the cleaner moving in direction 66. In this figure, both vortex's, and thus turbines 63, rotate in the same direction, and thus the cleaner will move forward in an approximately straight line.

Figures 34, 35:
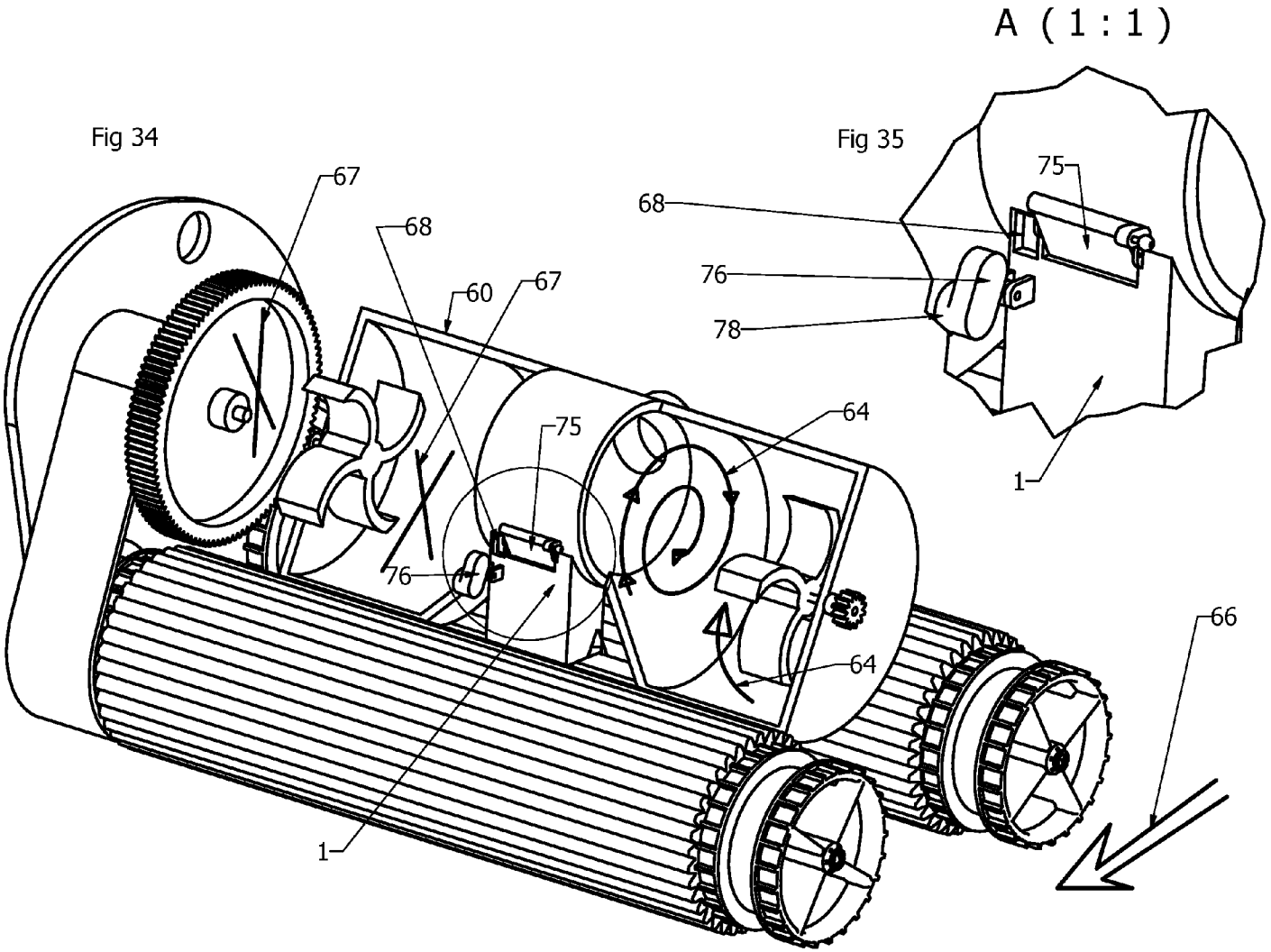
FIG. 34 illustrates a top perspective cutaway view of the cleaner of FIG. 29, with the steering flap in the open position.
FIG. 35 is a close-up perspective view of the reverse and steering flap area in FIG. 34.
Figures 36, 37, 38, 39:
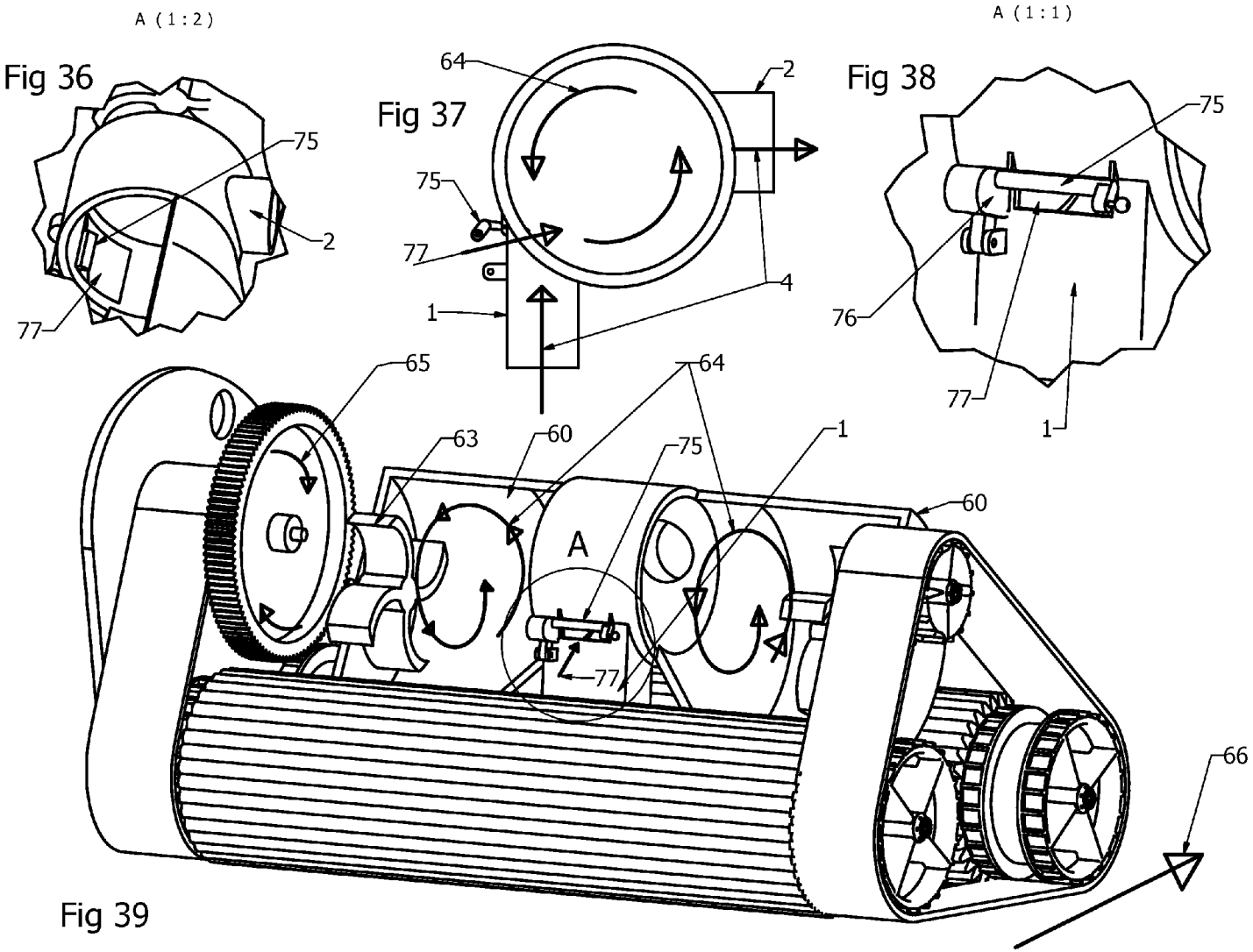
FIG. 36 is a close-up perspective view of the inlet-outlet area in FIG. 39.
FIG. 37 is a side view of the inlet-outlet area in FIG. 39.
FIG. 38 is a close-up perspective view of the reverse flap area in FIG. 39.
FIG. 39 illustrates a top perspective cutaway view of the cleaner of FIG. 29, with the steering flap in the closed position and the reverse flap in the open position.

Under normal operating conditions on pool floor with suction applied, cleaner will continue in a straight line as depicted in FIGS. 31, 32, and 33. The steering flap 76 is biased towards a closed position by a small float 78 integrated within the steering flap 76. When the cleaner transitions to a vertical position, such as on a pool wall or step area, the float 78 in steering flap 76 will bias steering flap 76 to the open position as seen in FIGS. 34 and 35, thereby allowing a very small flow volume to enter through intake orifice 68, with resulting interference in the flow intake channel 1. This disruption of flow will in turn slow down or stop the vortex and turbine in one of the dual chambers 60, depicted by cross 67 in FIGS. 34 and 35. The smaller orifice 68, the less the disruption of the formed vortex within the chamber 60 thus resulting in slowing down rather than completely stopping the turbine.

The resulting slow down or stopping of the turbine and gear train in one of the dual chambers shown by 60 will not affect the rotation of the vortex and subsequent turbine rotation in the other dual chamber, see arrows 64 in FIGS. 34 and 35. The side not affected will therefore continue in direction of arrow 66, whereas the opposite side will receive no or less input from the turbine depending on size of orifice 68, and the cleaner will steer towards the side where turbine is stopped or slowed down. This steering function is important since it is desirable to prevent the cleaner from reaching the surface of the water and sucking air into the cleaner.

Tests have shown that a very small orifice is all that is needed to influence the flow pattern sufficiently such that vortex will come to a standstill in the affected chamber. This is significant in that the cleaner should still have sufficient flow through the inlet 1 and through outlet 2 to adhere to the pool surfaces when the reverse or steering function is activated. Preferably, a mechanical cam device, similar to that described above, activates the steering flap if desired when the cleaner is in a horizontal position. If desired, a second flap opposite the first will disrupt vortex in the opposing chamber thereby allowing steering effect towards both directions. In such instance, it speaks for itself that only one of the steering flaps will be engaged at any one time whether by flotation or other means.

In FIGS. 36 through 39, the reverse flap 75 is in an open position, thereby allowing a small volume of flow to enter through orifice 77 in the direction depicted by the corresponding arrow. The resulting interference to the flow pattern through inlet 1 will cause a deflection of the flow from inlet 1 to outlet 2 to the extent that the formed vortex within both chambers 60 will be reversed, as shown by flow directional arrows 64. The resultant reversed vortex and turbine rotation and drive gear, as shown by arrow 65, will have the effect that cleaner will reverse direction, as shown by directional arrow 66.

As can be seen in the detailed views of FIG. 36 through 39, the reverse flap 75 will not cut off the flow volume through inlet 1; rather, reverse flap 75 will only partially intrude into the inlet 1. Note that there has to be enough flow through inlet 1 to keep the cleaner adhered to pool surfaces when the reverse mechanism is activated. Preferably, a mechanical cam device, similar to that described above, activates the reverse flap 75.

Even though this configuration shows the two turbines at opposite sides of the in and outlet, the configuration can include both turbines to be placed adjacent to each other on one side of the vortex chamber, wherein the chamber will be similar to the one described for the single turbine.

Figure 40:
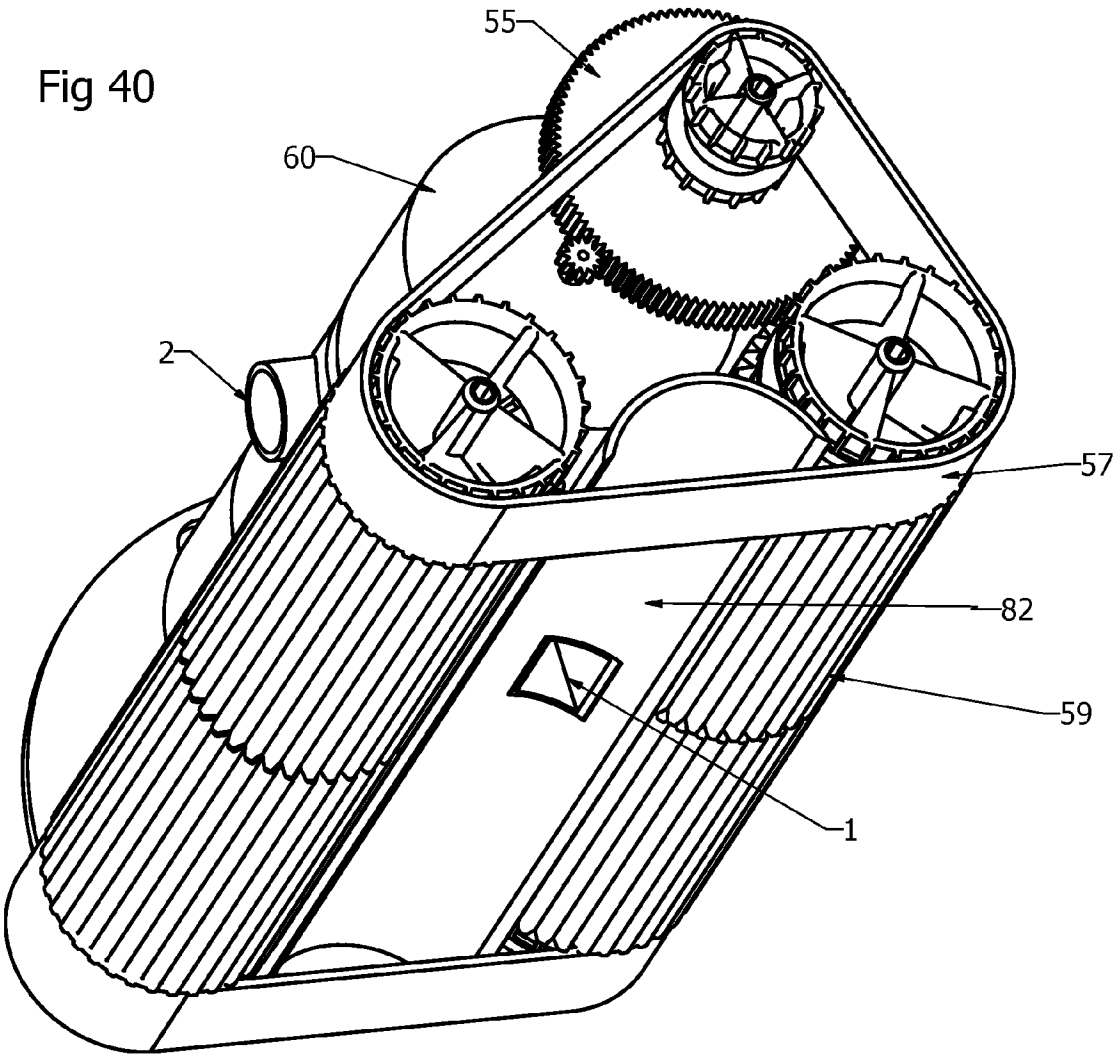
FIG. 40 is a bottom perspective view of the cleaner of FIG. 29.

FIG. 40 is a bottom perspective view of the cleaner of FIG. 29. The bottom of the clean includes a curved plate 82. Curved plate 82 includes an opening for inlet 1. The shape of the curved plate 82 promotes the flow of fluid from underneath the cleaner to the inlet 1.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

What I claim is:

1. A device for cleaning a surface submerged in a fluid comprising:

a vortex turbine mechanism, where the vortex-turbine mechanism comprises an inlet, an outlet, a vortex chamber, and a turbine, where fluid will flow from the inlet to the outlet and form a vortex in the vortex chamber when suction is applied to the outlet, where the turbine is located within the vortex chamber and not within the direct flow path between the inlet and outlet, where the turbine rotates as a result of the vortex created in the vortex chamber, and where the turbine produces drive power when it rotates, where the vortex-turbine mechanism further comprises a reverse flap and an orifice, where the reverse flap has an open position and a closed position, where the reverse flap allows fluid to flow through the orifice when in the open position, whereby fluid entering through the orifice reverses the rotation of the vortex and therefore the rotation of the turbine.

2. The device of claim 1, further comprising an additional turbine, where the additional turbine is located within the vortex chamber and not within the direct flow path between the inlet and outlet, where the additional turbine rotates as a result of the vortex created in the vortex chamber, and where the additional turbine produces drive power when it rotates.

3. The device of claim 1, where reversing the rotation of the turbine causes the device to reverse the direction it moves.

4. The device of claim 1, further comprising a drive wheel, where the turbine drives the drive wheel.

5. The device of claim 4, further comprising a track, where the track is driven by the drive wheel.

6. The device of claim 1, further comprising two output shafts, where the output shafts are driven by the turbine.

7. The device of claim 6, where the device can travel in a different direction by applying a braking force to one of the output shafts thereby causing one output shaft to transfer more drive power than the other therefore causing one track to move faster than the other.

8. A device for cleaning a surface submerged in a fluid comprising an inlet, an outlet, two chambers, and two turbines, where each chamber has one of the turbines therein, where fluid travelling through the inlet and then through the outlet forms a vortex in each of the chambers, where the vortex drives the turbines within the chambers, and further comprising a steering flap, where the steering flap has an open position and a closed position, where steering flap causes the vortex in one chamber to be faster than the vortex in the other chamber when in the open position.

9. The device of claim 8, further comprising a float, where the float causes the steering flap to change to the open position when in more of a vertical orientation and causes the steering flap to change to the closed position when in more of a horizontal orientation.

10. The device of claim 8, further comprising two drive wheels, where each turbine is mechanically connected to one of the drive wheels.

11. The device of claim 10, further comprising two tracks, where each track is mechanically connected to one of the drive wheels, whereby when the turbine rotates the drive wheels rotate, and when the drive wheels rotate the tracks rotate thereby causing the device to move.

12. The device of claim 8, wherein each chamber is on opposing sides of the inlet and outlet.

13. The device of claim 8, wherein the chambers are not directly between the inlet and the outlet.

14. A device for cleaning a surface submerged in a fluid comprising an inlet, an outlet, two chambers, two turbines, and a reverse flap, where each chamber has one of the turbines therein, where fluid travelling through the inlet and then through the outlet forms a vortex in each of the chambers, where the vortex drives the turbines within the chambers, where the reverse flap has an open position and a closed position, where rotation of the vortex within the chambers is reversed when the flap moves from the open position to the closed position.

15. The device of claim 14, further comprising a steering flap, where the steering flap has an open position and a closed position, where the steering flap causes the vortex in one chamber to be faster than the vortex in the other chamber when in the open position.

16. The device of claim 15, further comprising a float, where the float causes the steering flap to change to the open position when in more of a vertical orientation and causes the steering flap to change to the closed position when in more of a horizontal orientation.

17. The device of claim 14, wherein each chamber is on opposing sides of the inlet and outlet.

* * * * *